US011261743B2

(12) United States Patent
Besnard et al.

(10) Patent No.: US 11,261,743 B2
(45) Date of Patent: Mar. 1, 2022

(54) DEVICE FOR MASKING A TURBOMACHINE ROTOR

(71) Applicant: SAFRAN AIRCRAFT ENGINES, Paris (FR)

(72) Inventors: Nicolas Léon Jean-Baptiste Besnard, Moissy-Cramayel (FR); Romain Jean-François Guerit, Moissy-Cramayel (FR); Laurent Miguel Sanchez, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 122 days.

(21) Appl. No.: 16/382,059

(22) Filed: Apr. 11, 2019

(65) Prior Publication Data

US 2019/0316476 A1 Oct. 17, 2019

(30) Foreign Application Priority Data

Apr. 12, 2018 (FR) ..... 1853193

(51) Int. Cl.
*F01D 5/28* (2006.01)
*F01D 11/00* (2006.01)
*F01D 25/00* (2006.01)

(52) U.S. Cl.
CPC ..... *F01D 5/288* (2013.01); *F01D 5/286* (2013.01); *F01D 11/003* (2013.01); (Continued)

(58) Field of Classification Search
None
See application file for complete search history.

(56) References Cited

U.S. PATENT DOCUMENTS 4,820,118 A * 4/1989 Yano ..... F01D 17/165 415/161
6,109,843 A 8/2000 Descoteaux
(Continued)

FOREIGN PATENT DOCUMENTS

DE 10 2015 212 502 A1 1/2017
EP 1 795 706 A1 6/2007
FR 3 014 944 A1 6/2015

OTHER PUBLICATIONS

French Search Report and Written Opinion issued in corresponding French Application No. 1853193, filed Apr. 12, 2018, 7 pages.

*Primary Examiner* — Mikhail Kornakov
*Assistant Examiner* — Pradhuman Parihar
(74) *Attorney, Agent, or Firm* — Christensen O'Connor Johnson Kindness PLLC

(57) ABSTRACT

A device for masking the inner periphery of a disc of a turbine engine generally includes a lower element, an upper element, and an elastic annular seal. The lower element, the upper element, and the elastic annular seal are coaxial, the elastic annular seal arranged longitudinally between the lower element and the upper element. The seal generally includes a lower annular part bearing radially and internally against the lower element, and an upper annular part bearing radially and internally against the upper element. The lower part and the upper part are connected to one another by an annular central part forming a return element. The elastic annular seal is configured to bear longitudinally, radially, and externally against each longitudinal end of said inner periphery of the disc to mask said inner periphery, and a clamping system capable of clamping the seal between the lower element and the upper element.

21 Claims, 2 Drawing Sheets

(52) U.S. Cl.
CPC ..... *F01D 25/002* (2013.01); *F05D 2220/30* (2013.01); *F05D 2230/90* (2013.01); *F05D 2300/611* (2013.01)

(56) References Cited

U.S. PATENT DOCUMENTS

| | | | | |
|---|---|---|---|---|
| 2014/0241858 | A1* | 8/2014 | Tashiro | F04D 29/083 415/111 |
| 2016/0265378 | A1* | 9/2016 | Dungs | F01D 5/12 |
| 2017/0016346 | A1 | 1/2017 | Domalain | |
| 2018/0355751 | A1* | 12/2018 | Tibbetts | F01D 25/007 |

* cited by examiner

DEVICE FOR MASKING A TURBOMACHINE ROTOR

BACKGROUND

The state of the art comprises, in particular, the document FR-A1-3 014 944.

For the purpose of assembling the parts of a turbine engine, a step is implemented whereby blades are mounted on the periphery of a disc or a turbine engine. The disc is a rotating part of the turbine engine connected to the low-pressure shaft or the high-pressure shaft of the turbine engine. The blades, once mounted on the disc, enable the transfer of energy from the primary flow to one of these shafts.

The disc can comprise a sealing flange in a radially interior area that is intended to bear against a part, for example a bearing secured to an inner sealing casing. Since the radially interior area is an area where significant contact occurs, the sealing flange is made of a wear-resistant material. The sealing flange can, for example, be coated in a resistant alloy such as the cobalt-chrome-molybdenum alloy marketed under the name of TRIBALOY® T-800 by the company Kennametal, at 1600 Technology Way, Latrobe, Pa. 15650.

During maintenance and/or repair operations of the disc, prior to the inspection of the part, the disc is removed and undergoes a cleaning operation. The cleaning may implement several baths, some of which are likely damage the resistant material of the sealing flange of the disc.

For masking purposes, it has been recommended to use chemical agents; however, in the medium or long term, these agents can be carcinogens, mutagens or substances toxic to reproduction. These agents are called CMR agents.

Another solution is to apply a metallic material on the resistant material of the sealing flange of the disc, but this solution does not adapt to dimensional variations of the flange that occur during normal operation of the flange during flights.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to one or more aspects of the present disclosure, a device for masking the inner periphery of a disc of a turbine engine is provided. The device generally includes a lower element, along a longitudinal axis; an upper element, along a longitudinal axis; a elastic annular seal, along a longitudinal axis, the lower element, the upper element and the seal being coaxial, the seal being arranged longitudinally between the lower element and the upper element, the seal comprising a lower annular part bearing radially and internally against the lower element, an upper annular part bearing radially and internally against the upper element, the lower part and the upper part being connected to one another by an annular central part forming a return element, said seal being further configured to bear longitudinally, radially and externally against each longitudinal end of said inner periphery of the disc, so as to mask said inner periphery, and a clamping system, capable of clamping the seal between the lower element and the upper element.

Thus, the flexible seal is able to adapt to deformations of the inner periphery. The central part of the seal forming a return element is able to compress the seal which fit that way and absorbs said deformations of the periphery. The masking of the periphery is carried out in a simple manner, the seal surrounding radially and longitudinally each longitudinal end of the periphery. The device is able to mask the periphery and to allow the passage of the cleaning liquid towards the middle of the device.

The central part of the seal can comprise a V-shaped revolution section.

The lower part and the upper part of the seal advantageously comprise a revolution section comprising a radially-oriented portion and a longitudinally-oriented portion, which allow to bearing longitudinally, radially and externally against each longitudinal end of the inner periphery of the disc.

The lower part can comprise a beveled revolution section, of which a radially internal portion is intended to engage and bear against a frustoconical surface of the lower element and a radially external portion is intended to engage and bear against a lower end of the inner periphery of the disc.

The upper part can comprise an L- or T-shaped revolution section, of which a radially internal portion is intended to engage and bear against a shoulder of the upper element and a radially external portion is intended to engage and bear against an upper end of the inner periphery of the disc.

The lower and upper elements can be cylindrical plates.

The lower element and the upper element can comprise orifices for the circulation of a cleaning liquid.

The clamping system can comprise a threaded rod secured to the lower element and go through the seal and the upper element, and a nut bearing against the upper element.

The present disclosure also relates to a disc of a turbine engine.

The disc according to the present disclosure is provided with a device such as described above.

The inner periphery can be a layer of material of a sealing flange.

The present disclosure also relates to a method for masking the inner periphery of a disc of a turbine engine:

The method according to the present disclosure implements a device such as described above.

The method can, in particular, comprise the following steps:

- a step whereby the lower element is positioned in a central bore of the disc;
- a step whereby the seal is positioned on the inner periphery to be masked, the lower part of the seal bearing radially and internally against the lower element;
- a step whereby the upper element is positioned, a shoulder of the upper element being arranged on the upper part of the seal; and
- a clamping step implementing the clamping system, the lower element moving in a translational manner in the bore under the effect of tightening, so as to compress the lower part of the seal.

The method can comprise, after the clamping step, a step whereby the disc is cleaned.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present disclosure relates to a device for masking the inner periphery of a disc of a turbine engine, such as a sealing flange of a disc of a high-pressure compressor to efficiently mask the inner element while complying with EHS (environment, health and safety) regulations. The present disclosure also relates to a process for cleaning the disc implementing the device, among other aspects.

Figure 1:
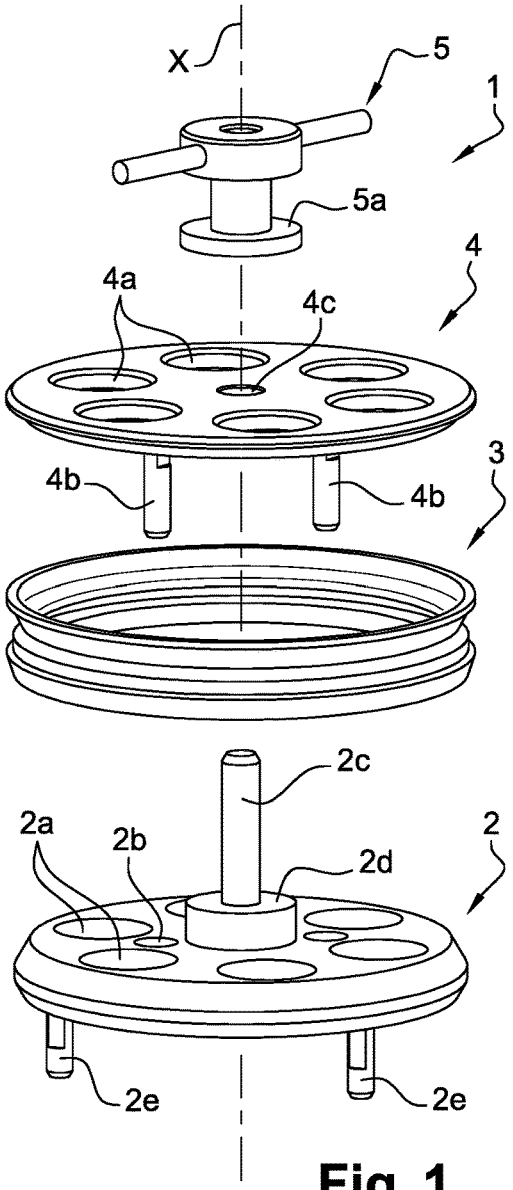
FIG. 1 is an exploded perspective view of one representative embodiment of a device for masking the inner periphery of a disc of a turbine engine in according with one or more aspects of the present disclosure.

As shown in FIG. 1, a device 1 for masking the inner element of a disc of a turbine engine according to the present disclosure comprises a lower element 2, a seal 3, an upper element 4 and a nut 5. The seal 3 is intended to be sandwiched between the lower element 2 and the upper element 4. The lower element 2, the seal 3, the upper element 4 and the nut 5 are coaxial along a longitudinal axis X. Furthermore, the lower element 2, the seal 3, and the upper element 4 have substantially the same diameter.

The upper element 4 is in the form of a circular plate provided with orifices 4*a*, for example cylindrical, allowing the cleaning product to circulate. Guiding elements 4*b*, for example in the form of cylindrical rods, guide the upper element 4 in the lower element 2 and secure it to the latter. Conventionally, the upper element 4 is made of stainless steel.

The lower element 2 is also in the form of a circular plate provided with orifices 2*a* that are distributed in the same manner as the orifices 4*a* of the upper element 4, so as to be arranged the orifices 4*a* face to face when the guiding elements 4*b* are introduced in the reception elements 2*b* of the lower element 2. The reception elements 2*b* are for example cylindrical through-orifices. The lower element 2 also comprises a threaded rod 2*c* made in the thickness of the lower element 2 and oriented towards the top of the lower element 2 and intended to intersect with the upper element 4 by a through-hole 4*c* of the upper element 4. The threaded rod 2*c* can emerge from a central baseplate 2*d* that protrudes from the surface of the lower element 2. The lower element 2 can also comprise one or several rods 2*e* oriented towards the bottom of the lower element 2 and intended to be positioned on a support table, not shown, of the masking device 1. Conventionally, the lower element 2 is made of stainless steel coated in polytetrafluoroethylene (PTFE).

The nut 5 cooperates with the threaded rod 2*c* to tighten the assembly and to maintain the seal 3 in contact with the lower element 2 and with the upper element 4. The nut 5 comprises a baseplate 5*a* that bears against the upper element 4 around the orifice 4*c*. In other embodiments, any fixing means which allow to clamp the seal 3 between the upper element 4 and the lower element 2, such as by implementing a compression with a clamping fasteners or an axis with pressure pins is within the scope of the present disclosure.

Figure 3:
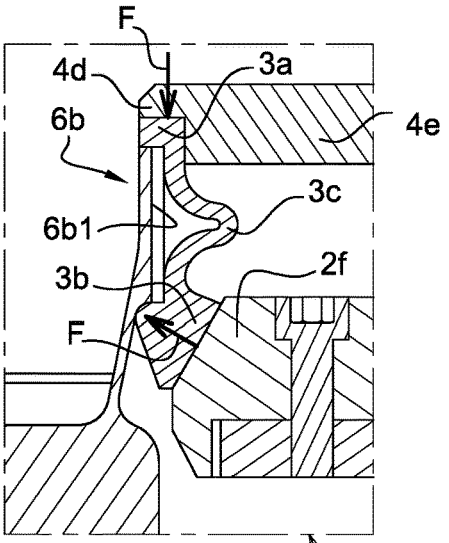
FIG. 3 is a partial detailed view of FIG. 2.
Figure 2:
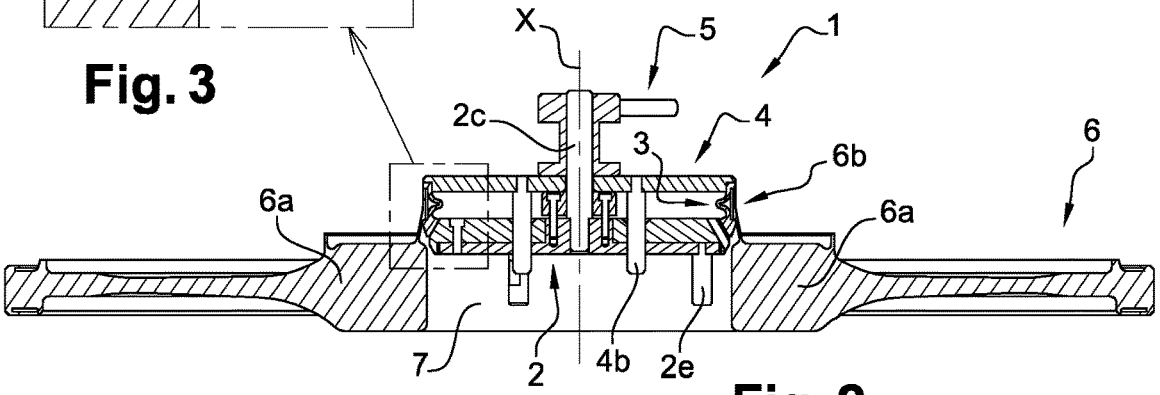
FIG. 2 is a cross-section view of a turbine engine disc with the device of FIG. 1.
Figure 4:
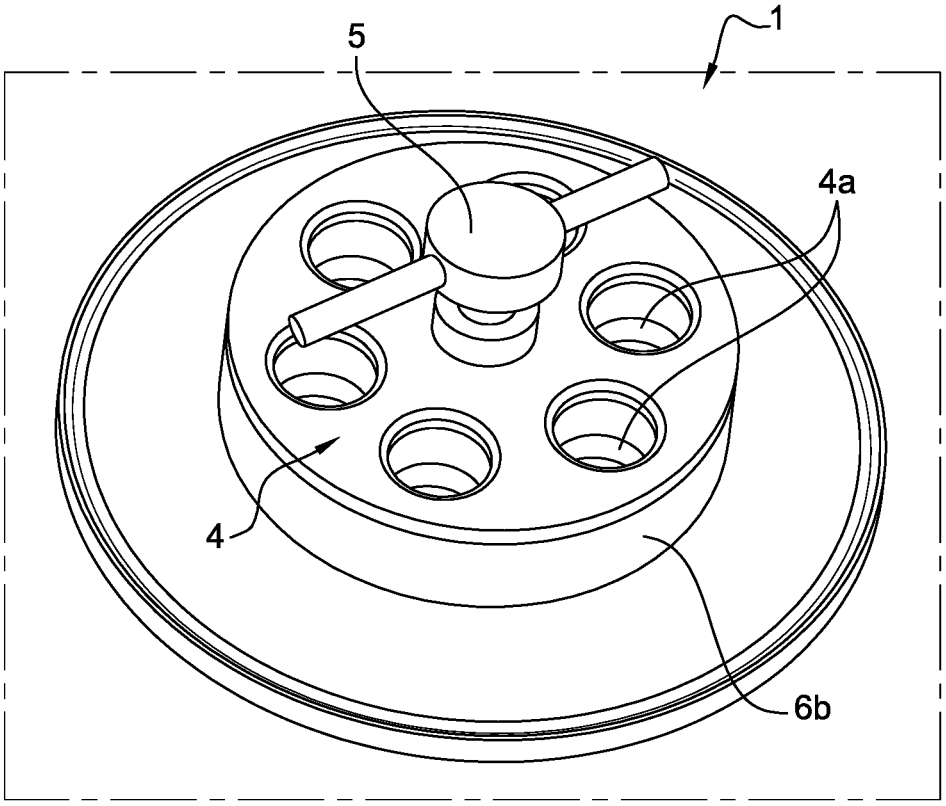
FIG. 4 is a partial top and perspective view of the disc of FIG. 2.

The seal 3 has a specific shape that is described in relation to FIGS. 2 and 3. It is made of an elastic material, typically a silicon elastomer, which allows for improved immersion qualities in acid baths.

FIGS. 2 and 3 show the disc 6 of a turbine engine, provided with the masking device 1. The disc 6 is typically a disc of a high-pressure compressor. The disc 6 comprises a radially internal massive part 6*a*, located radially on the side of a central bore 7 of the disc 6. The massive part 6*a* is provided at its radially inner end with an annular sealing flange 6*b* that is slightly off-centered with respect to the plane of the disc 6 and that extends longitudinally. The terms "radial" and "longitudinal" are defined with respect to the axis of symmetry X of the disc 6 (and of the device 1), which is perpendicular to the plane of the disc 6.

The sealing flange 6*b* is intended to engage and bear against a bearing secured to an inner sealing casing. Since this is an area where significant contact occurs, the sealing flange 6*b* is made of a wear-resistant material. The sealing flange 6*b* can therefore be coated in an annular layer 6*b*1 made of a resistant material, such as a resistant alloy, for example a cobalt-chrome-molybdenum alloy marketed under the name of TRIBALOY® T-800 by the company Kennametal.

The purpose of the masking device 1 is therefore to protect the layer 6*b*1 of resistant material from the effects of cleaning baths used during cleaning operations of the disc 6. More specifically, the seal 3 provides this masking function. The seal 3 has an annular shape, and is a full part rotating about an axis X, obtained from a section comprising an upper part 3*a* intended to bear against the upper element 4 of the masking device 1, and a lower part 3*b* intended to engage and bear against the lower element 2 The upper part 3*a* is also intended to engage and bear against an upper longitudinal end of the layer 6*b*1 of resistant material, whereas the lower part 3*b* is also intended to engage and bear against a lower longitudinal end of the layer 6*b*1 of resistant material. The upper part 3*a* and the lower part 3*b* are connected to one another by a central part 3*c* forming the return element. The central part 3*c* typically has a V-shape.

The upper part 3*a* of the seal 3 bears internally and radially against a shoulder of the upper element 4. The shoulder is formed by the outer diameter difference between an upper cylindrical portion 4*d* of the upper element 4 and a lower cylindrical portion 4*e* of the upper element 4. The upper cylindrical portion 4*d* has a diameter that is greater than that of the lower cylindrical portion 4*e*. The lower part 3*b* of the seal 3 bears internally and radially against the frustoconical upper part 2*f* of the lower element 2. The lower part 3*b* of the seal 3 is beveled to facilitate the lower part 3*b* bear against the frustoconical upper part 2*f* of the lower element 2.

In some embodiments, the seal 3 is configured to fit with the contour of the longitudinal ends of the layer 6*b*1 of resistant material, both radially and longitudinally. Therefore, the upper part 3*a* of the seal 3 advantageously fits with the contour of the upper longitudinal end of the layer 6*b*1, whereas the lower part 3*b* of the seal 3 advantageously fits with the contour of the lower longitudinal end 6*b*1 of the resistant material, which allow to mask the layer 6*b*1 of resistant material and prevents it from coming into contact with the cleaning product circulating at the center of the device 1. The seal 3 therefore radially and longitudinally covers each longitudinal end of the layer 6*b*1 and the V-shaped return portion is arranged internally in the central part of the layer 6*b*1, located between its two longitudinal ends. The seal 3 therefore forms a shoulder in which each longitudinal end of the layer 6*b*1 is embed itself.

The specific shape of the seal 3 therefore seals the inner periphery (the layer 6*b*1 of the resistant material of the sealing flange 6*b*) of the disc 6. Its geometry with the return element, for example a V-shape, provides a compression zone on each of the upper and the lower side. Compressions are realized by the lower element 2 and the upper element 4 of the device, which are typically metallic elements. The compression directions of the seal 3 are shown in FIG. 3 by arrows F. The specific shape of the seal 3 enables it to fit optimally with the contact surfaces of the sealing flange and with the lower 2 and upper 4 elements.

The assembly of the device 1 with the disc 6 may comprise the following steps:

- placing the disc 6 flat on a support table;
- positioning the lower element 2 in the central bore 7 of the disc 6, the lower rods 2*e* of the lower element 2 are positioned on the support table;
- positioning the seal 3 on the coating 6*b*1 to be protected, the lower part 3*b* of the seal 3 being bearing against the upper frustoconical part 2*f* of the lower element 2;
- positioning the upper element 4, the shoulder of the upper element 4 being arranged on the upper part 3*a* of the seal 3;
- tightening the assembly using the element of the nut 5; during tightening, the lower element 2 moves in a translational manner in the bore 7 and compresses the lower part 3*b* of the seal 3; and
- cleaning the disc 6.

Thus, no force is applied on the layer 6*b*1 of resistant material during the masking phase. The mask removal phase is carried out easily by simply disassembling the device 1 without leaving residue on the masked zone.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A device for masking the inner periphery of a disc of a turbine engine, comprising: a lower element along a longitudinal axis; an upper element along the longitudinal axis; an elastic annular seal along the longitudinal axis, the lower element, the upper element and the elastic annular seal being coaxial, the elastic annular seal being arranged longitudinally between the lower element and the upper element, the elastic annular seal comprising: a lower annular part bearing radially and internally against the lower element; and an upper annular part bearing radially and internally against the upper element, the lower annular part and the upper annular part being connected to one another by an annular central part forming a return element, the elastic annular seal being further configured to bear longitudinally, radially, and externally against each longitudinal end of the inner periphery of the disc to mask the inner periphery; and a clamping system configured to clamp the seal between the lower element and the upper element; wherein the upper element is in the form of a circular plate provided with first orifices for cleaning product to circulate, and with guiding elements for securing the upper element on the lower element, wherein the lower element is in the form of a circular plate provided with second orifices for cleaning product to circulate, and with reception elements for securing the upper element in the lower element, and wherein the first orifices of the upper element and said second orifices of the lower element are arranged face to face, and said guiding elements are introduced in said reception elements.

2. The device according to claim 1, wherein the annular central part of the elastic annular seal has a V-shaped revolution section.

3. The device according to claim 1, wherein the lower annular part and the upper annular part of the elastic annular seal have a revolution section comprising a radially-oriented portion and a longitudinally-oriented portion.

4. The device according to claim 1, wherein the lower annular part features a beveled revolution section, of which a radially internal portion is configured to engage and bear against a frustoconical surface of the lower element, and a radially external portion is configured to engage and bear against a lower end of the inner periphery of the disc.

5. The device according to claim 1, wherein the upper annular part features an L-shaped revolution section, of which a radially internal portion is configured to engage and bear against a shoulder of the upper element, and a radially external portion is configured to engage and bear against an upper end of the inner periphery of the disc.

6. The device according to claim 5, wherein the shoulder is formed by an outer diameter difference between an upper cylindrical portion of the upper element and a lower cylindrical portion of the upper element, wherein the upper cylindrical portion has a diameter that is greater than a diameter of the lower cylindrical portion.

7. The device according to claim 1, wherein the lower element and the upper element are cylindrical plates.

8. The device according to claim 1, wherein the lower element and the upper element comprise orifices for the circulation of a cleaning liquid.

9. The device according to claim 1, wherein the clamping system comprises a threaded rod secured to the lower element and intersecting with the elastic annular seal and the upper element, and a nut bearing against the upper element.

10. A disc of a turbine engine having a device according to claim 1.

11. The disc according to claim 10, wherein the inner periphery is a layer of material of a sealing flange.

12. The device according to claim 1, wherein the lower element, the elastic annular seal and the upper element have a same diameter.

13. The device according to claim 1, wherein said guiding elements are in the form of cylindrical rods.

14. The device according to claim 1, wherein said reception elements are cylindrical through-orifices.

15. The device according to claim 1, wherein the lower element comprises also a threaded rod oriented towards a top of the lower element, wherein the threaded rod is configured to traverse the upper element by a through-hole of said upper element.

16. The device according to claim 15, wherein said threaded rod has a thickness of the lower element.

17. The device according to claim 1, wherein the lower element comprises one or several rods oriented towards a bottom of the lower element.

18. The device according to claim 17, wherein said rods each have a thickness of the lower element.

19. The device according to claim 1, wherein the upper annular part features a T-shaped revolution section, of which a radially internal portion is configured to engage and bear against a shoulder of the upper element, and a radially external portion is configured to engage and bear against an upper end of the inner periphery of the disc.

20. The device according to claim 19, wherein the shoulder is formed by an outer diameter difference between an upper cylindrical portion of the upper element and a lower cylindrical portion of the upper element, wherein the upper cylindrical portion has a diameter that is greater than a diameter of the lower cylindrical portion.

21. The device according to claim 1, wherein the lower annular part of the seal fits with a contour of a lower longitudinal end and an upper longitudinal end of the inner periphery.

* * * * *